US006964616B2

(12) United States Patent
Dombrowski

(10) Patent No.: US 6,964,616 B2
(45) Date of Patent: Nov. 15, 2005

(54) ADJUSTABLE PUTTER FOR DUAL HANDED USE

(76) Inventor: Doug C. Dombrowski, 453 Library Ave., Carnegie, PA (US) 15106

( * ) Notice: Subject to any disclaimer, the term of this patent is extended or adjusted under 35 U.S.C. 154(b) by 10 days.

(21) Appl. No.: 10/827,589

(22) Filed: Apr. 19, 2004

(65) Prior Publication Data

US 2005/0233821 A1 Oct. 20, 2005

(51) Int. Cl.[7] ..... A63B 69/36

(52) U.S. Cl. ..... 473/239; 473/246; 473/248; 473/288; 473/296; 473/307

(58) Field of Search ..... 473/239, 244–248, 473/288, 296, 305–315

(56) References Cited

U.S. PATENT DOCUMENTS

| | | | | | |
|---|---|---|---|---|---|
| 1,253,700 | A | * | 1/1918 | McLaughlin | 473/288 |
| 1,648,806 | A | * | 11/1927 | Hadden | 473/296 |
| 1,697,846 | A | * | 1/1929 | Anderson | 473/246 |
| 1,713,158 | A | * | 5/1929 | Anderson | 473/247 |
| 2,027,452 | A | * | 1/1936 | Rusing | 473/246 |
| 2,056,335 | A | * | 10/1936 | Wettlaufer | 473/245 |
| 2,155,830 | A | * | 4/1939 | Howard | 473/246 |
| 2,275,330 | A | * | 3/1942 | Tveten | 280/823 |
| 2,336,405 | A | * | 12/1943 | Kent | 473/245 |
| 2,475,927 | A | * | 7/1949 | Verderber | 473/296 |
| 3,214,170 | A | * | 10/1965 | Warnock | 473/248 |
| 3,368,812 | A | * | 2/1968 | Baldwin, Sr. | 473/330 |
| 4,121,832 | A | * | 10/1978 | Ebbing | 473/335 |
| 4,171,108 | A | * | 10/1979 | Ishida et al. | 242/231 |
| 4,778,180 | A | * | 10/1988 | Guenther | 473/248 |
| 4,884,808 | A | * | 12/1989 | Retzer | 473/288 |
| 5,083,779 | A | * | 1/1992 | Ungermann | 473/239 |
| 6,723,000 | B1 | * | 4/2004 | Dombrowski | 473/239 |

* cited by examiner

*Primary Examiner*—Sebastiano Passaniti
(74) *Attorney, Agent, or Firm*—John D. Gugliotta; P. Jeff Martin

(57) ABSTRACT

A putter comprises a linearly elongated telescopic shaft having a handle or grip at an end. The shaft is coupled to a putter head at an opposing (lower or inferior) end. The head is adjustable for altering the lie angle of the putter. The putter may further comprise an offset elbow disposed between the shaft and the head. The elbow is rotatable through 360° about the lower or inferior end of the shaft, thus allowing the rotation of the head 16 about the shaft for selecting a right-handed or left-handed putting orientation.

8 Claims, 6 Drawing Sheets

ADJUSTABLE PUTTER FOR DUAL HANDED USE

RELATED APPLICATIONS

This application claims the benefit of U.S. Non-Provisional application Ser. No. 09/821,902 filed on Mar. 30, 2001.

BACKGROUND OF THE INVENTION

1. Field of the Invention

The present invention relates generally to golfing putter and, more particularly, to a golfing putter adaptable for use in a right-handed or left-handed orientation.

2. Description of the Related Art

A multitude of golfing putters have been developed and commercialized to aid amateur and professional golfers in reducing the number of strokes exhausted on or around the putting green. Most of the golfing putters developed overcome the prior art by adjusting the lie of the shaft, the loft of the putter face, the weight of the putter head, the appearance of the putter head, and/or offset of the shaft relative to the putter head. These modifications attempt to address particular features that might be sensitive to individual golfers.

The present invention recognizes a need for a golfing putter that incorporates the features of a telescopic shaft, an adjustable lie shaft, an adjustable loft putter face, and a rotatable head for orientation in a right-handed or left-handed putting orientation. Each feature includes unique aspects and benefits to the user, and makes the present invention easy to manufacture, maintain, use and adjust by a single or multiple users.

SUMMARY OF THE INVENTION

It is therefore an object of the present invention to provide an improved golfing putter.

It is a feature of the present invention to provide a golfing putter adaptable for adjustment of the lie of the shaft and/or loft of the putter face.

It is another feature of the present invention to provide a golfing putter adaptable for aligning the putter head and face for right-handed or left-handed putting.

It is another feature of the present invention to provide a golfing putter having a telescopically adjustable shaft for extending or shortening the length of the shaft as desired.

Briefly described according to one embodiment of the present invention, a putter comprises a linearly elongated telescopic shaft having a handle or grip at an end. The shaft is coupled to a putter head at an opposing (lower or inferior) end. The head is adjustable for altering the lie angle of the putter. The putter may further comprise an offset elbow disposed between the shaft and the head. The elbow is rotatable through 360° about the lower or inferior end of the shaft, thus allowing the rotation of the head 16 about the shaft for selecting a right-handed or left-handed putting orientation.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

For purposes of this disclosure, and to clarify potentially unfamiliar terms, the following terms or phrases are defined as used in the golfing art:

"Loft" or "loft angle" is defined as the angle between the ground and the club face, provided that the club is properly resting flat on the ground. The angle ($\angle\alpha$) depicted in FIG. ? is an example of the "loft" or "loft angle" of one embodiment.

"Lie" or "lie angle" of a golf club, including a putter, is defined as the angle between the ground and the shaft of the club, provided that the club is properly resting flat on the ground surface. The angle ($\angle\beta$) depicted in FIG. ? is an example of the "lie" or "lie angle" of one embodiment.

"Skidding" is an action that commonly occurs during the first few feet of travel after a golf ball has been struck by a putter. "Skid" is attributed to poor distance and line control, and on uneven or spike-torn greens, exposes the ball to topographic influence.

Figure 1:
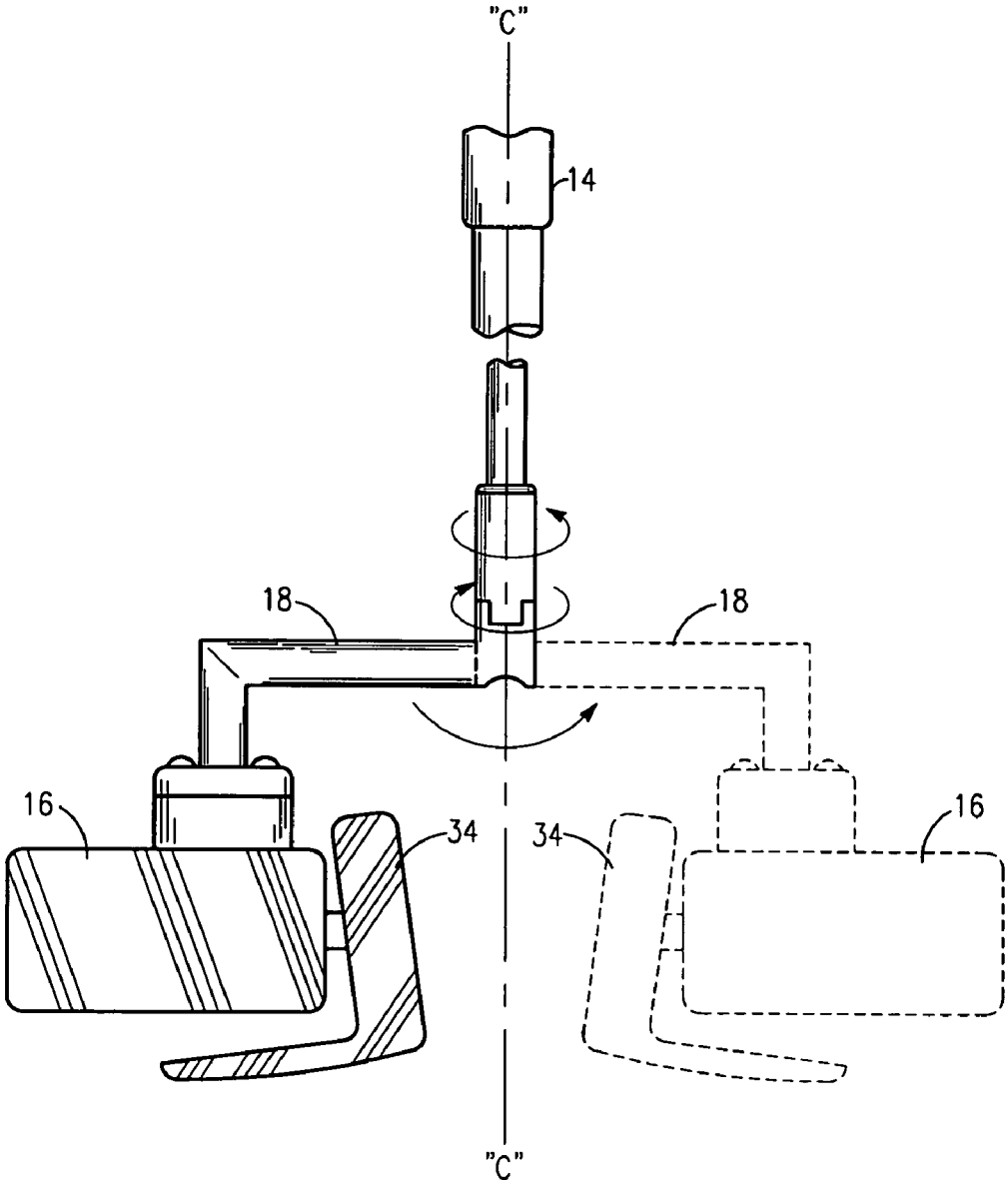
FIG. 1 is a side view of an adjustable putter for dual handed use.
Figure 2:
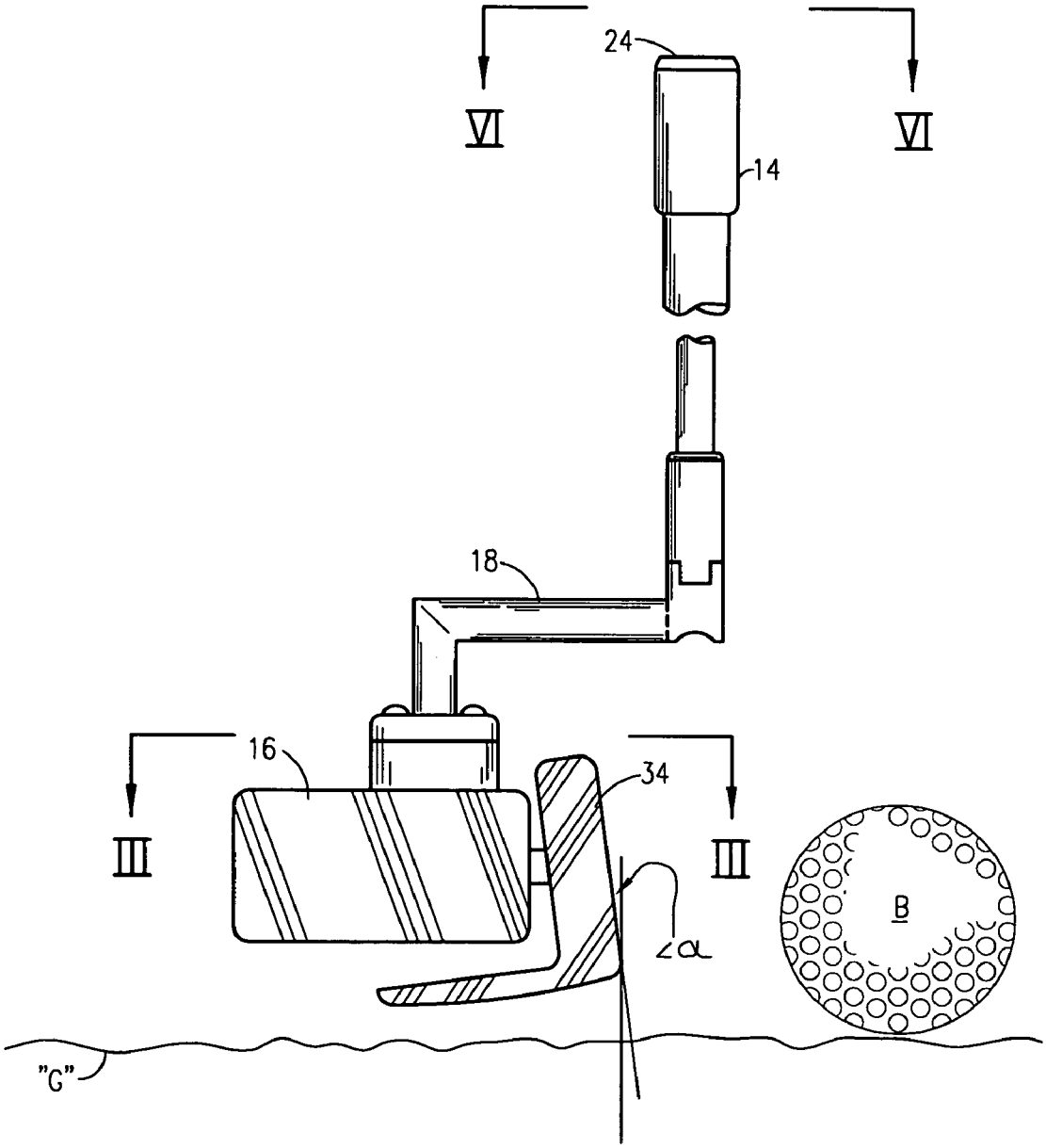
FIG. 2 is a side view of the putter head and elbow.
Figure 3:
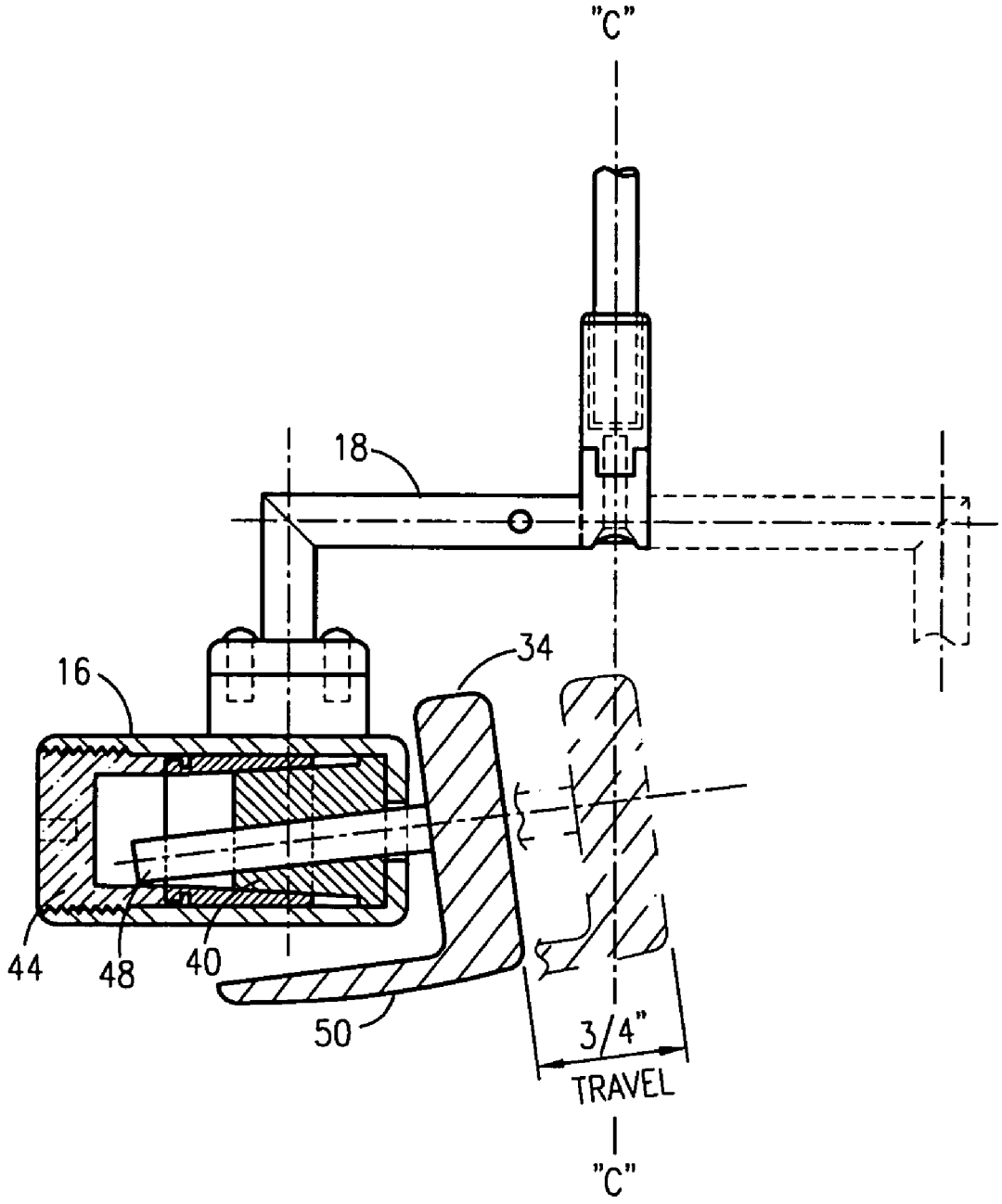
FIG. 3 is a sectional view of the putter head taken along line III—III of FIG. 2.
Figure 4:
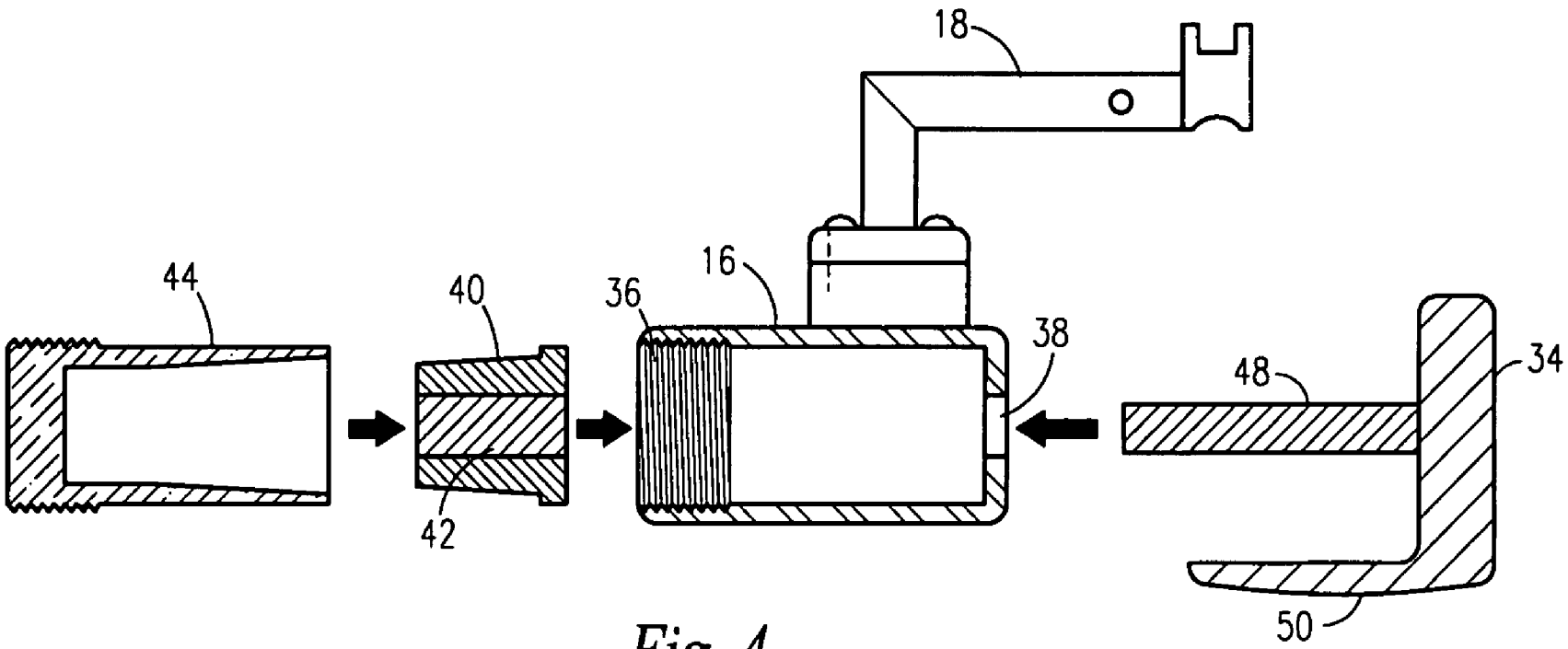
FIG. 4 is an exploded sectional view of the putter head having a substantially hollow compartment in which an insert and a sleeve are inserted at the posterior end and a face with a post are inserted at the anterior end, the post impinged by the bore formed in the sleeve at a specified loft angle.
Figure 5:
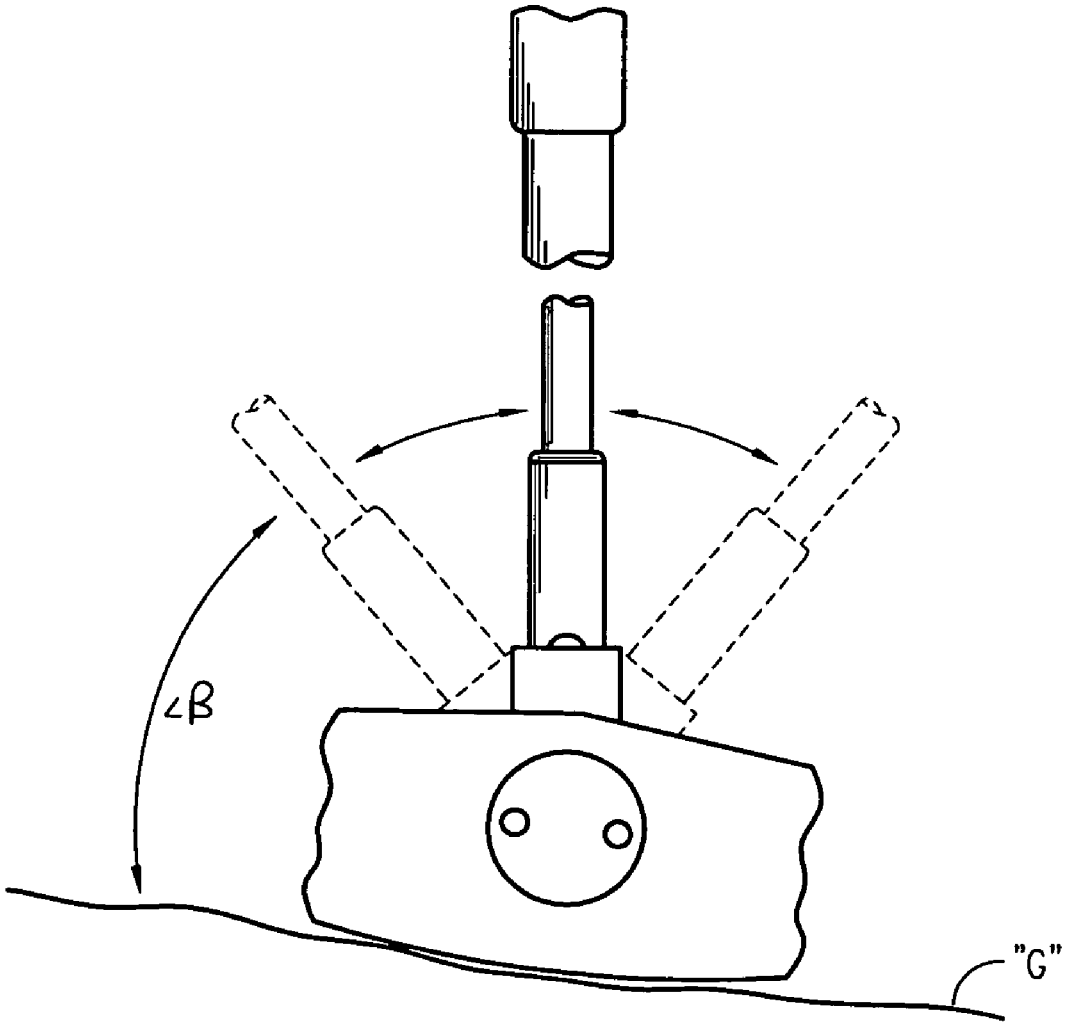
FIG. 5 is a rear view of the putter illustrating the variation in lie angle of the shaft relative to the ground.
Figure 6:
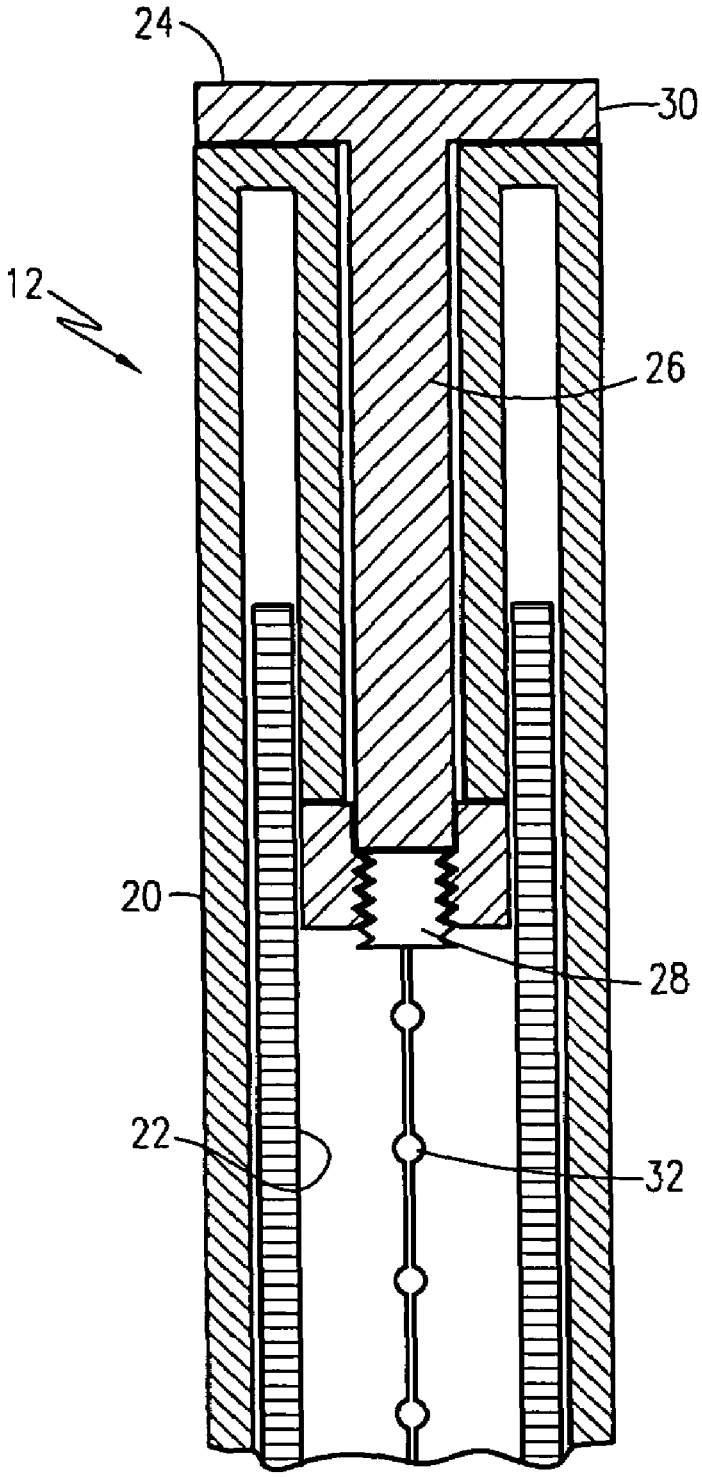
FIG. 6 is a sectional view of the handle on the upper shaft taken along line VI—VI of FIG. 2.

The best mode for carrying out the invention is presented in terms of its preferred embodiment, herein depicted within FIGS. 1 through 6.

1. Detailed Description of the Figures

Referring to FIG. 1 through FIG. 6, a golf putter 10 (hereinafter "putter") is shown in accordance with a preferred embodiment of the present invention. The putter 10 comprises a linearly elongated telescopic shaft 12 having a handle or grip 14 at an (upper or superior) end, and the shaft 12 is coupled to a putter head 16 at an opposing (lower or inferior) end. The head 16 is adjustable for altering the lie angle of the putter 10. The putter 10 may further comprise an offset elbow 18 disposed between the shaft 12 and the head 16. The elbow 18 is rotatable through 360° about the lower or inferior end of the shaft 12, thus allowing the rotation of the head 16 about the shaft 12 for selecting a right-handed or left-handed putting orientation.

The shaft 12 comprises an upper shaft 20 and a lower shaft 22 telescoping within the upper shaft 20. Means 24 for selectively engaging the upper shaft 20 and the lower shaft 22 at a fixed profile is provided along the upper and lower shafts 20 and 22, respectively. Means 24 comprises a rotatable rod 26 having an index pin 28 at an end thereof. The rod 26 and pin 28 are supported within the upper shaft 20 and selectively rotatable by a disc 30 formed at the upper end of the upper shaft 20. A plurality of index slots 32 having a variety of vertical profiles are provided and supported within the lower shaft 22. The pin 28 engages one of the slots 32, thus impinging the upper shaft 20 and the lower shaft 22 at a fixed profile relative to one another. The pin 28 engages one of the slots 32 by concurrent rotation or selective positioning of the disc 30 and the rod 26, respectively, the user rotating the disc 30, the disc 30 rotating the rod 26, and the rod 26 rotating the pin 28 to selective positions. The shaft 12 (including lower shaft 22) is adjustable so that the lie angle may be adjusted to accommodate a specific lie angle. The shaft 12 is envisioned to adjust about a pivot and set at the specified angle by a fastener or fasteners to securely maintain that desired angle.

The head 16 is adjustable about the elbow 18 (described in greater detail below) for selective adjustment of the lie $\angle\beta$ of the putter 10. The head 16 includes a face 34 for striking a golf ball "B". The head 16 comprises a substantially hollow internal compartment 36 centrally aligned on the head 16. An opening 38 for ingress and egress of the face 34 is provided centrally aligned with the compartment 36. A sleeve 40 with an angled bore 42 is positioned within the compartment and adjacent the opening 38, the bore 42 maintaining the face 34 at a selected loft angle $\angle\alpha$. The sleeve 40 comprises one of a plurality of interchangeable sleeves 40 having one of the loft angles, each interchangeable sleeve 40 corresponding to a specific loft angle between 0° and 8°. Thus, in one envisioned embodiment, nine individual sleeves 40 may be provided to accommodate the loft angle range of 0° and 8°. In another envisioned embodiment, five individual sleeves 40 may be provided to accommodate the loft angle $\angle\alpha$ range of 0° and 8° in 2° increments (beginning with 0°, and including 2°, 4°, 6° and 8°, respectively). Each sleeve 40 may be fabricated from a durable material, including metal, hardened plastic and/or rubber, among other suitable materials known in the art. An insert 44 is positioned posterior to the sleeve 40, the insert 44 impinging the sleeve 40 and the bore 42 therein, preferably by mateable threading with the internal threads of the compartment 36. The insert 44 includes an end 46 (annular in form) that encompasses the sleeve 40, intermediately between the sleeve 40 and the internal walls of the head 16. Thus, the insert 44 is impinged between the head 16 and the sleeve 40, inwardly pressing on the sleeve 40 to securely maintain the positioning of the sleeve 40 and to impinge a post 48 of the face (described in greater detail below) within the bore 42 as the post 48 passes therethrough. Like the sleeve 40, the insert 44 may be fabricated from a durable material, such as metal, hardened plastic and/or rubber, among other suitable materials known in the art.

The face 34 is adjustable about the head 16 for selective adjustment of the loft angle $\angle\alpha$ of the face 34. The face 34 has a linearly elongated post 48 projecting from the rear of the face 34. The post 48 may be circular or orthogonal in cross-section, so long as the post 48 substantially conforms to the geometric configuration and dimensions of the bore 42 through which the post 48 must pass. In combination with the sleeve 40 (and the bore 42 therein) and the insert 44, the post 48 of face 34 is selectively positioned and maintained at a specific loft angle $\angle\alpha$ in accordance with the desire of the user and the sleeve 40 selected (having a specified angle for the bore 42 and post 48). The face 34 also includes a rail 50 projecting from an inferior end of the face 34 approximately 90° thereto. The rail 50 provides a guide and support for the face 34 and the putter 10, in general, by slightly elevating the putter 10 from the surface of the putting green "G" and encouraging contact at or near the equator of the golf ball "B", encouraging over spin and preventing skidding along the putting green "G" in the first few feet of the putt.

The elbow 18 is disposed between the shaft 12 and the head 16. The elbow 18 offsets the head 16 from the shaft 12. Offset of the head 16 in relation to the shaft 12 promotes "rolling" of the ball and minimizes "skidding". The elbow 18 is secured in a specific orientation by an adjustable fastener 52 coupling the elbow 18 to the shaft 12. The elbow 18 selectively rotates 360° about the shaft 12 for selecting a right-handed or left-handed putting orientation. The elbow 18 selectively rotates by releasing or loosening the fastener 52, thus elbow 18 freely rotates in either a clockwise or counterclockwise direction about the shaft 12.

It is envisioned that other styles and configurations of the present invention can be easily incorporated into the teachings of the present invention, and only one particular configuration shall be shown and described for purposes of clarity and disclosure and not by way of limitation of scope.

2. Operation of the Preferred Embodiment

The use the present invention, a user will (in no particular order) adjust the length of the shaft, the lie of the shaft relative to the putter head, and the loft of the putter face, and the orientation of the putter head.

The length of the shaft 12 is adjusted by rotation of the disc 30 and rod 26 concurrently, thereby removing the pin 28 from an index slot 32. The release of the pin 28 from slot 32 permits the lower shaft 22 to move within the upper shaft 20 to a desirable profile. Once a desirable profile is achieved, the user will rotate the disc 30 in the opposite direction of the release rotation, thereby inserting the pin 28 into a different index slot 32, thereby maintaining the shafts 20 and 22 at that specified profile.

The shaft 12 (including lower shaft 22) is adjustable so that the lie angle may be adjusted to accommodate a specific lie angle. The shaft 12 is envisioned to adjust about a pivot and set at the specified angle by a fastener or fasteners to securely maintain that desired angle.

The loft of the puffer face 34 is adjustable by removing the putter face 34 and post 48 from the sleeve 40 placed within the putter head 16. An alternative sleeve 40 with an alternative bore 42 (having a different bore angle) replaces the preceding sleeve 40, as desired. The different bore 42 maintains the post 48 at a different angle than before, thus altering the loft angle of the putter face 34 as desired.

The putter head 16 is rotatable about the shaft 12 so that a right-handed or left-handed orientation can be achieved. The putter head 16 is held in a particular orientation by a recessed fastener 52 that couples the elbow 18 with the shaft 12 (specifically, the lower shaft 22). Loosening the fastener 52 allows the head 16 to rotate as desired. Once a specific orientation is achieve, the fastener 52 may be tightened to firmly secure that position for putting activities.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents. Therefore, the scope of the invention is to be limited only by the following claims.

What is claimed is:

1. A golf putter comprising:

a linearly elongated telescopic shaft having a handle affixed at an end thereof wherein said shaft comprises an upper shaft, a lower shaft telescoping within said upper shaft, and means for selectively engaging said upper shaft and said lower shaft at a fixed profile;

a putter head coupled to said shaft at an opposing end thereof, said head rotatable about said shaft said head offset from said shaft by an elbow;

said head adjustable for altering the lie of said putter;

a rotatable rod having an index pin at an end thereof and a disc at an opposite end, said rod supported within said upper shaft;

a plurality of index slots having a variety of vertical profiles, said slots supported by said lower shaft;

said pin engaging one of said slots for impinging said upper shaft and said lower shaft at a fixed profile, said pin selectively positioned by concurrent rotation of said disc and said rod.

2. The putter of claim 1, wherein said head is adjustable about said elbow for selective adjustment of the lie of said putter.

3. The putter of claim 1, wherein said head has a face for striking a golf ball.

4. The putter of claim 3, wherein said face is adjustable about said head for selective adjustment of the loft of said face.

5. A golf putter comprising:

a linearly elongated telescopic shaft having a handle affixed at an end thereof;

a putter head coupled to said shaft at an opposing end thereof, said head rotatable about said shaft and having a face for striking a golf ball;

wherein said head is adjustable for altering the lie of said putter and comprises:

a substantially hollow internal compartment centrally aligned on said head;

an opening for ingress and egress of said face;

a sleeve with an angled bore positioned adjacent said opening, said bore maintaining said face at a selected loft; and an insert positioned posterior to said sleeve, said insert impinging said sleeve and said bore therein.

6. The putter of claim 5, wherein said face has a linearly elongated post projecting from the rear, said post inserted into said bore.

7. The putter of claim 5, wherein said bore maintains said post and said face at a loft angle in a range of 0° and 8°.

8. The putter of claim 7, wherein said sleeve comprises one of a plurality of interchangeable sleeves having one of said loft angles.

* * * * *